United States Patent [19]

Bochinski et al.

[11] 4,383,346

[45] May 17, 1983

[54] CLEANING MEMBER FOR CLEANING THE INTERIOR OF HEAT EXCHANGER TUBES

[75] Inventors: Rolf Bochinski, Duisburg; Klaus Eimer, Ratingen; Hans W. Schildmann, Heiligenhaus; Günther Schmitz, Moers, all of Fed. Rep. of Germany

[73] Assignee: Taprogge Gesellschaft mbH, Düsseldorf, Fed. Rep. of Germany

[21] Appl. No.: 271,823

[22] Filed: Jun. 9, 1981

[30] Foreign Application Priority Data

Jun. 10, 1980 [DE] Fed. Rep. of Germany ..... 3021697

[51] Int. Cl.[3] ..... B08B 9/04

[52] U.S. Cl. ..... 15/104.06 R

[58] Field of Search ..... 75/3.5, 3.51, 104.06 R, 75/104.06 A

[56] References Cited

U.S. PATENT DOCUMENTS

| | | | |
|---|---|---|---|
| 3,204,274 | 9/1965 | Knapp | 15/104.06 R |
| 4,016,620 | 4/1977 | Powers | 15/104.06 R |
| 4,077,079 | 3/1978 | Knapp | 15/104.06 R |

*Primary Examiner*—Edward L. Roberts

*Attorney, Agent, or Firm*—Herbert L. Lerner; Laurence A. Greenberg

[57] ABSTRACT

Cleaning member for cleaning the interior of heat exchanger tubes by rotating, including a sponge rubber body having a given diameter, an adhesive film disposed on the sponge rubber body, and an abrasive layer formed of granular abrasive elements being fastened on the sponge rubber body by the adhesive film, the granular abrasive elements having an average linear dimension being smaller than the given diameter of the sponge rubber body, and the granular abrasive elements being disposed in a loose packing causing the abrasive layer to be deformable together with the sponge rubber body.

4 Claims, 3 Drawing Figures

CLEANING MEMBER FOR CLEANING THE INTERIOR OF HEAT EXCHANGER TUBES

The invention relates to cleaning members employing rotary action for cleaning the interior of heat exchanger tubes, especially tubes of condensers in steam power plants, including a sponge rubber body, and an abrasive layer of granular abrasive elements fastened on the sponge rubber body by means of an adhesive film or coating, the abrasive layer of granular abrasive elements having a median or average linear dimension which is considerably smaller than the diameter of the sponge rubber body. The diameter depends on the inside diameter of the tubes which are to be cleaned, and it lies in the range of 10 to 50 mm, for example. The sponge rubber bodies are generally of the open pore type. In a preferred embodiment, the sponge rubber bodies are sponge rubber spheres. The term sponge rubber is understood to include natural as well as synthetic rubber. Generally, heat exchanger tubes having a round cross section are cleaned with cleaning members of this type. The cleaning process in which the above-mentioned cleaning members are used is, in practice, generally known as the Taprogge-method.

In the measures known from practice, the abrasive elements form a dense, quasi gravel-like packing in the microscopic range, formed by several packing layers. Therefore, the term "packing" is meant to include a statistical distribution. A dense packing-layer of this type reduces the deformability of the sponge rubber body like a shell, and frequently breaks at a deformation similarly to a shell. This lack of capability to deform makes the cleaning members unsuited for the hereinafter-described application purpose in many cases, where the pressure difference between the input and output water chambers of the powerplant-condenser is insufficient to drive the spheres through the tubes. If the dense packing layer does break, dangerous sharp edges might be created, and in any case the useful life of the cleaning member itself is reduced.

It is accordingly an object of the invention to provide a cleaning member for cleaning the interior of heat exchanger tubes, which overcomes the hereinaforementioned disadvantages of the heretofore-known devices of this general type, and to do so in such a way that they exhibit good properties with respect to deformation, and thereby provide a predetermined and regulated abrasive effect with a long useful life and can be driven through the tubes with a small pressure differential.

With the foregoing and other objects in view there is provided, in accordance with the invention, a cleaning member for cleaning the interior of heat exchanger tubes, especially tubes of condensers in steam power plants, by rotating or circular action, comprising a sponge rubber body having a given diameter, an adhesive film disposed on the sponge rubber body, and an abrasive layer formed of granular abrasive elements being fastened on the sponge rubber body by the adhesive film, the granular abrasive elements having an average linear dimension being considerably smaller than the given diameter of the sponge rubber body, and the granular abrasive elements being disposed in a loose packing causing the abrasive layer to be deformable together with the sponge rubber body by small forces. As before, a loose packing is understood to be an arrangement with a statistical distribution of the abrasive elements, however in the form of a so-called one-layer packing, in which the abrasive elements can be deformed with respect to each other like the links in a fine chain, but which are connected by an adhesive film. Accordingly, the deformability of the whole cleaning member is practically determined by the sponge rubber sphere itself. Consequently a defined deformability results even if only small forces are applied.

In such a loose packing, the individual abrasive elements can still touch each other. The arrangement must only be made in such a manner that, no so-called explosive forces are generated in the abrasive layer.

In accordance with another feature of the invention, the abrasive layer has packing interspaces formed therein between at least some of the granular abrasive elements, i.e. between the individual abrasive elements and/or groups thereof. The size of these interspaces is so chosen in such a way that no bursting forces are generated in the abrasive layer when the cleaning members are being deformed. In this connection, in accordance with a further feature of the invention, there are provided film joints or joints of adhesive film disposed between at least some of the granular abrasive elements, i.e. between the individual abrasive elements and groups thereof.

In accordance with an added feature of the invention, the granular abrasive elements are corundum grains.

In accordance with a concomitant feature of the invention, the granular abrasive elements are grains of a synthetic material or short plastic mono-filament sections.

Other features which are considered as characteristic for the invention are set forth in the appended claims.

Although the invention is illustrated and described herein as embodied in a cleaning member for cleaning the interior of heat exchanger tubes, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
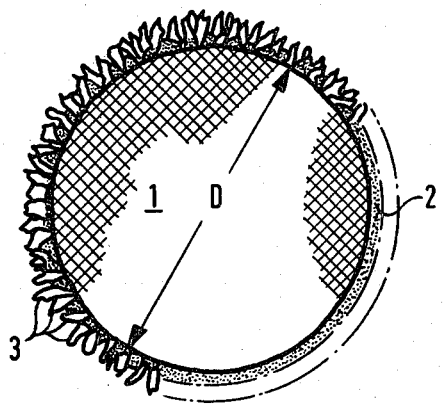
FIG. 1 is an enlarged, diagrammatic diametrical cross-sectional view of the cleaning member according to an embodiment of the invention.

Referring now to all of the figures of the drawing as a whole, it is seen that the cleaning member shown in the figures is intended for cleaning the interior of heat exchanger tubes, especially tubes or condensers of steam power plants, and is applicable for use in a cleaning method wherein the cleaning member rotates. In its basic construction, the cleaning member of the embodiment shown preferably includes, but is not limited to, a sponge rubber sphere 1 and an abrasive layer fastened thereupon with an adhesive film 2. The abrasive layer is formed of granular abrasive elements 3, having an average linear dimension which is considerably smaller than the diameter D of the sphere. For reasons of clarity, the abrasive elements 3 are shown with an exaggerated clearness in the drawing.

Figure 2:
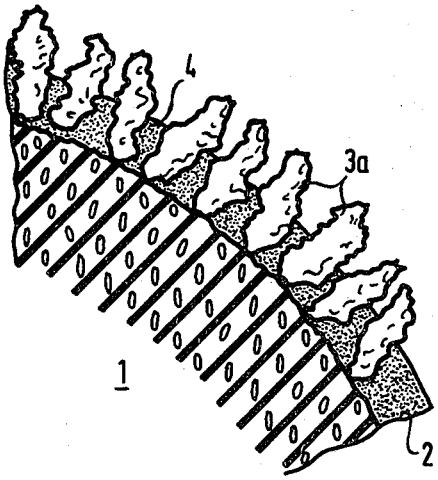
FIG. 2 is a further enlarged fragmentary view of FIG. 1.
Figure 3:
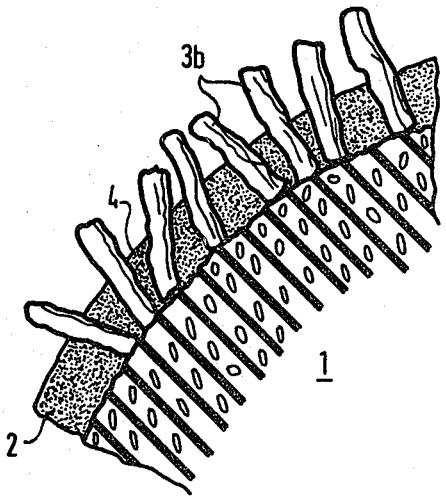
FIG. 3 is a view similar to FIG. 2 of a different construction form of a cleaning member according to the invention.

It can be seen especially in FIGS. 2 and 3 that the abrasive elements 3 are disposed in a loose packing, as a so-called single layer packing, so that the abrasive layer is therefore easily deformable together with the sponge rubber sphere 1 without a break. There are always packing-interspaces provided between the individual abrasive grains 3, and/or groups of the abrasive grains. So-called joints 4 of film of the abrasive layer are disposed between the individual abrasive grains and/or groups of abrasive grains 3. The joints are formed by the adhesive film 2 in such a manner that the hereinafter-described deformation between the abrasive elements 3 are made possible without generating any bursting forces. The film-joints 4 between the abrasive elements 3, and between the groups of abrasive elements, are, so-to-speak, left open therebetween.

In the embodiment according to FIGS. 1 and 2, the abrasive elements 3 would be most likely corundum grains 3*a*. In the embodiment according to FIG. 3, the abrasive elements are formed of short, plastic mono-filament sections 3*b*, which are so short that they function as granular abrasive elements.

There is claimed:

1. Cleaning member for cleaning the interior of heat exchanger tubes by circulating through the tubes under the force of a coolng water stream already existing in the tubes, comprising a spherical sponge rubber body having a given diameter, an adhesive film disposed on said spherical sponge rubber body, and an abrasive layer formed of granular abrasive elements being fastened on said spherical sponge rubber body exclusively by said adhesive film, said granular abrasive elements having an average linear dimension being smaller than said given diameter of said spherical sponge rubber body, and said granular abrasive elements being disposed in a loose packing having packing interspaces formed therein between said granular abrasive elements and joints of adhesive film between said granular abrasive elements causing said abrasive layer to be deformable together with said spherical sponge rubber body.

2. Cleaning member according to claim 1, wherein said granular abrasive elements are corundum grains.

3. Cleaning member according to claim 1, wherein said granular abrasive elements are grains of a synthetic material.

4. Cleaning member according to claim 1, wherein said granular abrasive elements are short plastic mono-filament sections.

* * * * *